United States Patent [19]

Yost

[11] Patent Number: 4,669,206

[45] Date of Patent: Jun. 2, 1987

[54] MANUAL SNOW CLEARING TOOL

[76] Inventor: Kenneth J. Yost, 10 Candy Ct., Eaton, Ohio 45320'

[21] Appl. No.: 830,692

[22] Filed: Feb. 18, 1986

[51] Int. Cl.[4] ..... E01H 5/02

[52] U.S. Cl. ..... 37/285; 294/54.5

[58] Field of Search ..... 37/265, 278, 284, 285; 294/54.5

[56] References Cited

U.S. PATENT DOCUMENTS

| | | | |
|---|---|---|---|
| 1,202,792 | 10/1916 | Brownstein | 37/266 X |
| 1,519,718 | 12/1924 | Blair | 37/266 |
| 1,667,591 | 5/1927 | Eden | 37/284 X |
| 3,248,811 | 5/1966 | Pravednekow | 37/265 |
| 4,094,543 | 6/1978 | Fratini | 294/54.5 |
| 4,512,091 | 4/1985 | Leininger et al. | 37/278 |

FOREIGN PATENT DOCUMENTS

| | | | |
|---|---|---|---|
| 1093023 | 1/1981 | Canada | 37/265 |
| 417321 | 10/1934 | United Kingdom | 37/278 |

*Primary Examiner*—Edgar S. Burr
*Assistant Examiner*—Moshe I. Cohen
*Attorney, Agent, or Firm*—Killworth, Gottman, Hagan & Schaeff

[57] ABSTRACT

A manual snow clearing tool includes a snow clearing blade formed by an elongated rectangular strip of flexible material placed in a flexed state and a handle connected to the strip to restrain and maintain it in its flexed state in which it forms the blade in a generally parabolic configuration. The blade formed by the strip is disposed with its height dimension extending upright from, and its length dimension extending parallel to, a surface to be cleared of snow. Also, rear portions and a forward arcuate portion of the flexed strip together define a forward snow plowing portion and a snow gathering cavity which is open at its top, bottom and rear end. The handle has laterally spaced apart lower ends which connect the rear portions of the flexible strip so as to maintain the rear strip portions in spaced apart relation such that the strip and the blade formed thereby naturally assumes the parabolic curvature. Also, the handle may be pivotal relative to the strip between respective positions for permitting use of the blade in either of two modes, to plow snow at its forward arcuate portion or to gather snow within its cavity through its open rear end. When pivoted to the position for use as a scoop to gather snow, the handle rests on respective stops mounted to the rear portions of the strip.

19 Claims, 3 Drawing Figures

MANUAL SNOW CLEARING TOOL

BACKGROUND OF THE INVENTION

The present invention generally relates to snow removal from walkways and driveways and, more particularly, to a manual snow clearing tool readily convertible for either plowing or scooping snow without lifting it or exerting much effort.

Manual snow removal from residential and commercial walkways and driveways is a demanding task due to the urgency with which it must ordinarily be done, the considerable effort that must usually be expended to accomplish it and the cold temperatures in which the work must normally be carried out. Because of these factors, it is not only an uninviting physical exercise, but more importantly, it constitutes a significant health hazard for a large segment of the population. As a result, many people feel the necessity to either purchase power-driven equipment, such as snow blowers or plows, to perform the task or hire others who have the equipment to provide such service.

Ownership of power-driven snow removal equipment has many drawbacks. First and foremost, there is its initial cost. Unless the area to be cleared of snow is fairly large and the expected frequency of snowfalls is high, it is difficult for many people to justify the initial investment. Then, at least annual service and maintenance is required to ensure that the equipment will be in working order when the need for its use arises. Also, fuel must be purchased and kept on hand to operate the equipment. Further, the handling of power-driven equipment in snow removal operations in cold weather and on slick surfaces is not an effortless exercise. Finally, when not being used power-driven equipment requires considerably more storage space than manual tools. Undoubtedly, given the aforementioned drawbacks of power-driven equipment, most people would opt for a manual snow removal tool if one was available which required little effort to use and was economical, durable and efficient.

Before the advent of power-driven snow removal equipment and continuing up to the present time, there has been a wide variety of manual or hand-powered tools designed for snow removal. The most common tool is the simple shovel having a generally flat or curved rectangular blade and a handle extending therefrom for directing the blade in pushing and lifting snow. Representative of the simple shovel and other prior art devices are the hand tools disclosed in Brownstein U.S. Pat. No. (1,202,792), Blair U.S. Pat. No. (1,519,718), Eden U.S. Pat. No. (1,667,591) and Fratini U.S. Pat. No. (4,094,543).

Of all of the above cited tools, only the Fratini device appears to be a step forward in hand-powered snow removal tool design. However, even it seems to embody several limitations which make it less than an optimum solution to the multi-faceted problem of providing a tool which, as outlined above, requires little effort to use while being economical, durable and efficient. Specifically, one limitation in the Fratini tool is the semicircular curvature of his blade which provides a rather blunt leading face which during use will push a significant amount of snow straight ahead in front of the tool. Hence, a relatively high amount of force is required to push the tool which becomes very noticeable in deep snow.

Another limitation of the Fratini tool design is the provision of the bottom edge of a curved blade as the sole contact interface with the surface to be cleared of snow and thus that portion of the device through which the pushing force is applied to move the blade across the snow covered surface. The curved edge requires such hard pushing to slide it across the surface as to render impractical its use on a hand-powered tool. A further limitation of the Fratini tool design is that it still requires lifting of the cleared snow when being used as a shovel. Still another limitation of the Fratini tool design is that it provides a substantially rigid structure which will incur bone-jarring impacts and transmit the same to the user's hands and body upon jamming into obstructions and irregularities in the surface being cleared when being used as either a snow shovel or plow.

Consequently, in view of the above-cited limitations present in the construction of the Fratini snow removal tool, it is readily apparent that the long-felt need still remains for a manual snow removal tool which addresses the aforementioned problem of providing a tool which requires little effort to use while being ecomonical, durable and efficient.

SUMMARY OF THE INVENTION

The present invention provides a manual snow clearing tool construction designed to satisfy the aforementioned long-felt need. The snow clearing tool of the present invention embodies design features which avoid all of the above-described limitations of the Fratini shovel by resolutely addressing and solving the outstanding problem of reducing the effort required to use a hand-powered tool to a level which accommodates the capabilities of the average person. In addition, the snow clearing tool of the present invention elminates two long-time bugaboos of snow shoveling, the constant lifting of a shovel loaded with snow and the frequent unexpected bone-jarring jamming of the shovel against surface obstructions. The tool is so ecomonical to own, easy to use and durable in its construction that the average person will find ownership of power-driven equipment even more undesirable and difficult to justify.

The snow clearing tool is basically comprised of a unique snow clearing blade and a handle. The blade is formed by an elongated strip of resiliently flexible material. The strip is placed and held in a flexed state and has a generally rounded, quasi-parabolic end configuration. In the flexed state, the strip forming the blade is disposed with its height dimension extending generally upright from, and its length dimension extending generally parallel to, a surface to be cleared of snow. Also, when placed in its flexed state, the strip has a pair of laterally spaced apart rear portions which merge into a forward generally parabolic convex snow plow defining portion. The rear portions and forward portion of the strip together define a concave snow gathering cavity which is open at its top, bottom and rear end.

The handle of the snow clearing tool is attached to the flexible strip so as to maintain or restrain it in its flexed state in which it forms the snow clearing blade. Preferably, the handle is so connected to the flexed strip that the strip, and thus the blade formed thereby, naturally assume a generally parabolic curvature. In particular, the handle, being in a generally inverted U-shaped configuration, has an upper gripping portion and laterally spaced apart lower ends which connect respectively to the rear portions of the strip of flexible material so as to maintain the rear strip portions in spaced apart relation.

Further, the handle may be pivotal relative to the strip between respective positions for permitting use of the blade in either of two modes, to plow snow at its forward generally parabolic convex portion or to gather snow within its concave cavity through its open rear end. When pivoted to the position for use as a scoop to gather snow, the handle rests on respective stops mounted to the rear portions of the strip adjacent the pivotal connections of the handle ends to the strip. Preferably, the pivotal connections and stops are located on the opposite facing interior surfaces of the blade within its snow gathering cavity.

Accordingly, it is an object of the present invention to provide a snow clearing tool which can effectively and efficiently be used by hand by the average person; to provide a snow clearing tool with a blade having a generally parabolic curvature which provide an optimum configuration for plowing snow with minimum effort; to provide a snow clearing tool with a blade having the degree of resilient flexibility needed to absorb shock forces generated upon striking a surface obstruction or irregularity; to provide a snow clearing tool with a blade composed of material having a low coefficient of friction; to provide a snow clearing tool that is capable of being readily stored by hanging straight against a wall; to provide a snow clearing tool readily convertible between snow plowing and gathering modes and which eliminates the need to lift snow when using the tool in the snow gathering mode; and to provide a snow clearing tool whose manufacture is exceedingly simple involving a minimal number of conventional operations and conventional materials, components and fasteners.

DETAILED DESCRIPTION OF THE PREFERRED EMBODIMENT

Figure 1:
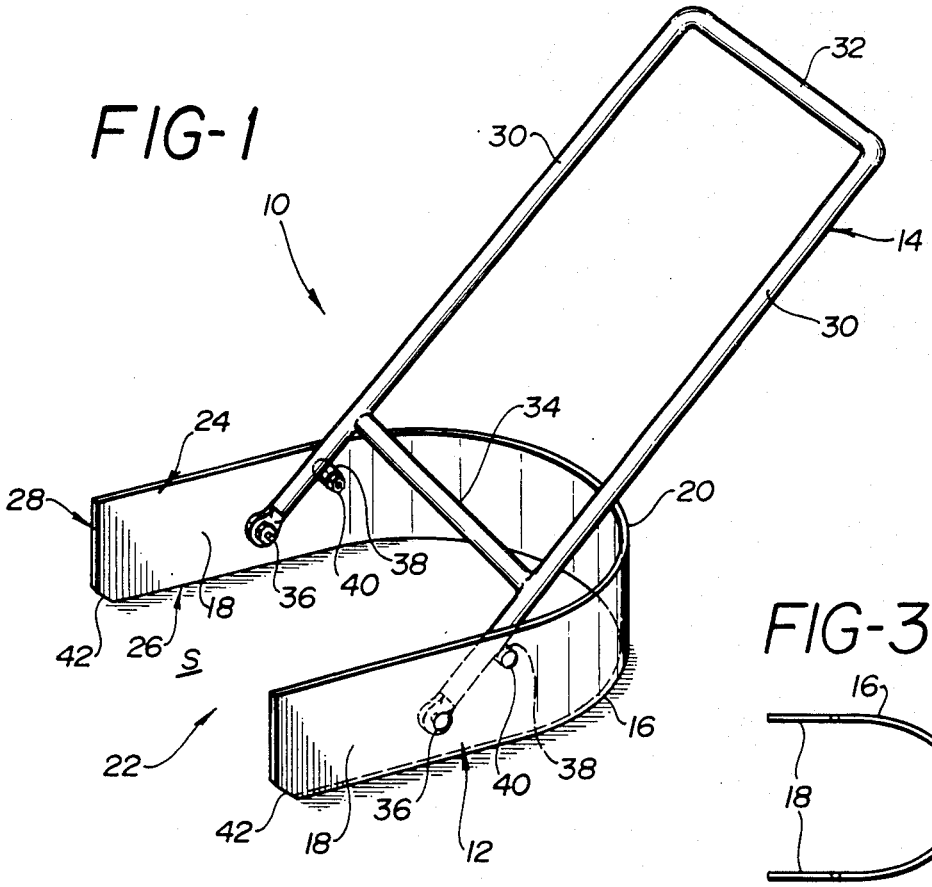
FIG. 1 is a perspective view of the manual snow clearing tool of the present invention with its handle placed in position for gathering snow.
Figure 2:
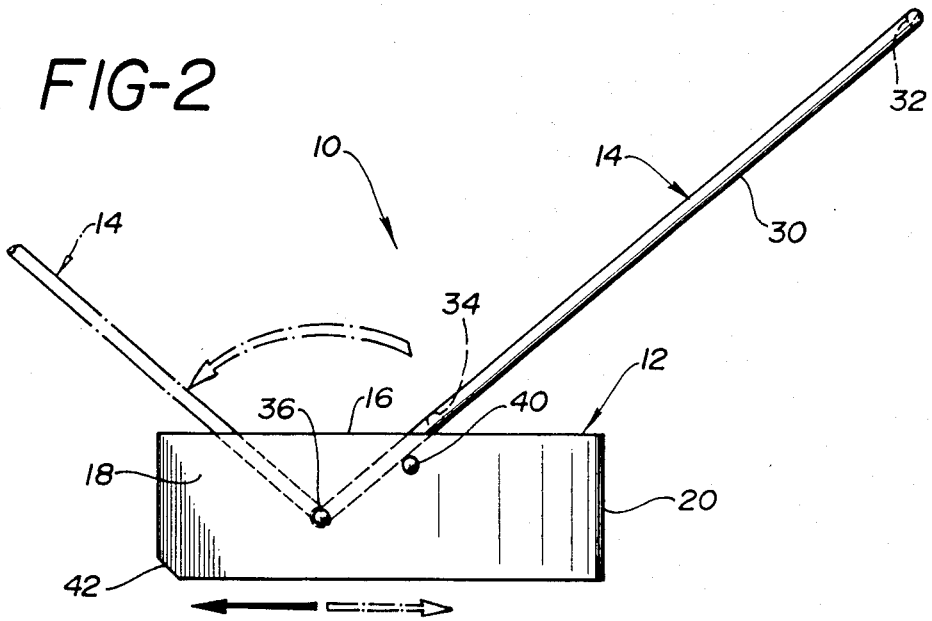
FIG. 2 is a side elevational view of the tool of FIG. 1, showing in fragmentary phantom outline form the other position of the tool handle for plowing snow.

Reference is made to FIGS. 1 and 2 of the drawings which illustrates a manual snow clearing tool, generally designated 10, which comprises the preferred embodiment of the present invention. The snow clearing tool 10 basically includes a unique snow clearing blade 12 and a handle 14. The snow clearing blade 12 is formed by an elongated, generally rectangular band or strip 16 of resiliently flexible material when the strip is placed in a predetermined flexed state. Most advantageously, the material of the strip 16 is a resiliently flexible plastic having a low coefficient of friction, high impact strength, high resistance to abrasion, and low moisture absorption characteristic. Specifically, the preferred plastic is ultra-high molecular weight polyethylene (UHMWPE), although a suitable alternative is Type F polyethylene. Ulta-high molecular weight polyethylene is commercially available from Dayton Plastics, Inc. of Dayton, Ohio.

In the flexed state, the strip 16 forming the blade 12 is disposed with its height dimension extending generally upright or perpendicular from, and its length dimension extending generally parallel to, the surface S to be cleared of snow. Also, when placed in its flexed state, the strip 16 has a pair of laterally spaced apart side or rear portions 18 which merge into a forward generally parabolic convex snow plow defining portion 20. The rear portions 18 and forward arcuate portion 20 of the strip together define a concave snow gathering cavity 22 which is open at its top 24, bottom 26 and rear end 28.

Figure 3:
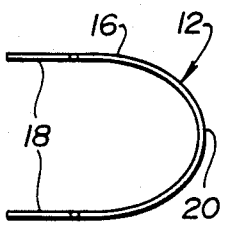
FIG. 3 is a top plan view of the snow clearing blade of the tool of FIG. 1 on a smaller scale, showing the generally parabolic curvature of the resiliently flexible strip forming the blade when the strip is restrained in a flexed state by the tool handle.

The handle 14 of the snow clearing tool 10 is attached to the flexible strip 16 so as to maintain and restrain it in its flexed state in which it forms the snow clearing blade 12. Preferably, the handle 14 is so connected to the flexed strip 16 that the strip, and thus the blade 12 formed thereby, naturally assume a generally approximate or quasi-parabolic curvature, as best seen in FIG. 3.

It would be beneficial at this point to briefly explain the advantages of the parabolic versus other shapes, for instance, the two extremes being a semi-circular shape on the one hand and a V-shape on the other. The parabolic shape results in a less blunt front "prow" around the longitudinal centerline of the tool 10, as compared to a semi-circular shape. The semi-circular curvature pushes more snow straight ahead in front of the blade, hence requiring more force to push the tool. Also, the parabolic shape has advantages over a V-shape. The latter causes too much snow to accumulate in ridges near the outside edges of the V, just before being moved to the sides. This causes much harder pushing than with the quasi or near-parabolic curvature. The key to minimized pushing force required by the quasi-parabolic curvature of the blade 12 is believed to be that the lateral velocity of the displaced snow begins at maximum at the tool's centerline where the snow layer is thinnest, then progressively diminishes as the snow layer progressively accumulates and becomes thicker until finally deposited off to the side. The push force resultant is more nearly the 45 degree optimum with the tool 10 than with tools employing either semi-circular or V-shaped blades. The shape becomes an even more significant advantage as the depth of the snow increases.

More particularly, the handle 14 has a generally inverted U-shaped configuration formed by a pair of spaced apart side bars 30 and an upper cross bar 32 which interconnects the upper ends of the side bars 30. Also, a lower cross bar 34 is fixed between the side bars 30 at locations spaced upwardly from their lower ends to stiffen the handle. The upper bar 32 is adapted to be gripped by the person to use the tool 10. Handle 14 may be fabricated of rigid plastic or metal tubing, with polyvinyl chloride being a preferred material of fabrication.

The lower ends of the handle side bars 30 are pivotally connected by fasteners 36 to the respective rear portions 18 of the flexible strip 16 so as to maintain the rear strip portions in spaced apart relation and the strip in its quasi-parabolic shape. The pivotal connections are located approximately midway between the rear edges of the rear portions 18 and the start of the forward arcuate or rounded end portion 20 of the strip 16. Additionally, the pivotal connections are preferably located approximately midway along the vertical height of the blade. At such locations of the pivotal connections of the handle 14 to the blade 12, the pushing force applied by the user will mainly bear on the bottom edges of the rear strip portions 18 which extend generally parallel to the direction in which the tool 10 is being pushed which makes it much easier to slide the tool 10 on the surface being cleared than a tool with solely a curved edge. Also, the tool 10 tends to "squeegee" or sweep the surface clean and free of snow because of the downward force of the bottom edge of the plastic material of the strip 16 against the concrete, asphalt or other type of surface. The flexibility of the strip 16 also provides a shock absorbing effect when the blade 12 encounters obstacles on the surface being cleared. This eliminates the occurrence of sudden bone-jarring jamming of the tool 10 upon impact with an obstacle.

Further, the handle 14 is pivotal relative to the strip 16 between respective positions for permitting use of the blade 12 in either of two modes, first, to plow snow at its forward generally parabolic convex portion 20 when the handle 14 is in the phantom position in FIG. 2 or, second, to gather snow within its concave cavity 22 through its open rear end 28 when the handle 14 is in the solid line position in FIG. 2. When pivoted to the position for use as a scoop to gather snow, the handle 14 adjacent its lower pivotally-connected ends rests on respective stops 38 mounted by fasteners 40 to the rear portions 18 of the strip 16 adjacent to and forwardly and upwardly of the pivotal connections 36 of the handle ends to the strip. When the tool 10 is used as a scoop, downward force is placed directly on the blade-mounted supports or stops 38 via the handle side bars 30. When used as a scoop or shovel, no actual lifting of the snow is required. The tool 10 is emptied merely by backing it away from the piled snow.

Preferably, as shown in FIG. 1, the pivotal connections 36 and stops 38 are located on the opposite facing interior surfaces of the blade 12 within its concave snow gathering cavity 22. In such location, they will not snag or hang up on structures or bushes located adjacent to the area being cleared of snow. Also, the rear lower corners 42 of the rear strip portions 18 are preferably beveled to allow the blade 12 to ride up over surface unevenness and irregularities when the tool 10 is being used to gather snow.

The manufacturing of the tool 10 is quite simple, requiring only a saw to rip out the bevel or chamfer on the corners 42 and a drill press to drill four holes to receive the fasteners 36 and 40. The strip 16 is flexed or bent cold into the generally U-shaped or quasi-parabolic blade 12 by hand at time of assembling with the handle 14. A standard lawnmower handle can also be used for handle 14. Because of its plastic blade, the tool 10 is very light to use and handle. It stores readily by hanging straight against the wall of a garage or other storage structure. Those skilled in the art will also appreciate that the tool 10 of the present invention may be easily modified to be mounted on a small tractor or other motorized device and used to plow or gather and scoop snow. It will also be apparent that a snow clearing tool may be formed by utilizing only one-half of the blade 12. That is, blade 12 may be formed such that one of the rearwardly extending portions 18 is attached at generally the midpoint of generally parabolic convex portion 20 and extends rearwardly therefrom. Such a configuration is intended to be within the scope of the present invention.

Having thus described the manual snow clearing tool of the present invention in detail and by reference to a preferred embodiment thereof, it will be apparent that modifications and variations are possible without departing from the scope of the invention defined in the appended claims.

What is claimed is:

1. A snow clearing tool selectively usable either to plow or to gather snow comprising:

a snow clearing blade formed by an elongated strip of resiliently flexible material placed and held in a flexed state and disposed with its height dimension extending generally upright from, and its length dimension extending generally parallel to, a surface to be cleared of snow, said strip having a pair of laterally spaced apart rear portions which merge into a forward generally parabolic convex snow plow defining portion, said rear portions and forward generally parabolic convex portion together defining a concave snow gathering cavity being open at its top, bottom and rear end; and a handle having laterally spaced apart lower portions pivotally connected respectively to said spaced apart rear portions of said strip of flexible material, said handle restraining said strip in its flexed state in which it forms said snow clearing blade, said handle being pivotal relative to said strip between respective positions for selectively permitting use of said blade either to plow snow at its forward generally parabolic convex portion or to gather snow within said concave snow gathering cavity through said open rear end thereof.

2. The tool of claim 1 in which said handle has a generally inverted U-shaped configuration with an upper gripping portion and laterally spaced apart lower ends which extend along the interior sides of, and are pivotally connected respectively to, the rear portions of the strip of flexible material so as to maintain the rear strip portions in said spaced apart relation.

3. The tool of claim 1 further comprising stops mounted to said rear portions of said strip adjacent the pivotal connections of said handle to said strip such that said lower portions of said handle rests on said respective stops when pivoted to the position for use of said blade as a scoop to gather snow.

4. The tool of claim 3 in which said pivotal connections and stops are located on the opposite facing interior surfaces of said rear portions of said strip within said concave snow gathering cavity.

5. The tool of claim 1 in which said strip is composed of plastic material having a low coefficient of friction and high impact strength and resistance to abrasion.

6. The tool of claim 5 in which said plastic material of said strip is a ultra-high molecular weight polyethylene.

7. A snow clearing tool comprising:

a snow clearing blade formed by an elongated strip of resilient flexible material placed and held in a flexed state and disposed in a configuration having a forward generally parabolic convex snow plow defining portion and a pair of laterally spaced apart side portions which together with said forward portion define a concave snow gathering cavity being open at its top, bottom and rear end; and a handle having laterally spaced apart lower portions connected respectively to said spaced apart side portions of said strip of flexible material restraining said strip forming said blade in its flexed state.

8. The tool of claim 7 in which said handle is connected for pivotal movement relative to said strip between respective positions for permitting use of said blade to plow snow at its forward generally parabolic convex portion or to gather snow within its concave cavity through said open rear end thereof.

9. The tool of claim 7 in which said handle has a generally inverted U-shaped configuration with laterally spaced apart lower ends which extend along the interior of, and are pivotally connected respectively to, the side portions of the strip of flexible material so as to maintain the side strip portions in said spaced apart relation.

10. The tool of claim 7 further comprising stops mounted to said side portions of said strip adjacent the pivotal connections of said handle to said strip such that said lower portions of said handle rests on said respective stops when pivoted to the position for use of said blade as a scoop to gather snow.

11. The tool of claim 10 in which said pivotal connections and stops are located on the opposite facing interior surfaces of said side portions of said strip within said snow gathering cavity.

12. The tool of claim 7 in which said strip has beveled lower rear corners for facilitating movement of said blade over uneven surfaces when being used to gather snow.

13. A snow clearing tool comprising:

a snow clearing blade formed by an elongated generally rectangular strip of resilient flexible material placed in a flexed state and disposed with its height dimension extending generally upright from, and its length dimension extending generally along, a surface to be cleared of snow, said strip when placed in said flexed state naturally having a generally parabolic curvature defining a forward convex snow plowing portion and a concave cavity being open at its top, bottom and rear end; and a handle connected to said strip of flexible material so as to restrain and maintain said strip in its flexed state in which it forms said snow clearing blade.

14. The tool of claim 13 in which said handle is connected for pivotal movement relative to said strip between respective positions for permitting use of said blade to plow snow at its forward convex portion or to gather snow within its concave cavity through said open rear end thereof.

15. The tool of claim 13 in which said handle has a generally inverted U-shaped configuration with laterally spaced apart lower ends extending along interior sides of, and pivotally connected respectively to, rear portions of said strip of flexible material so as to maintain said rear strip portions in a spaced apart relation.

16. The tool of claim 15 further comprising stops mounted to said rear portions of said strip adjacent the pivotal connections of said handle to said strip such that portions of said handle adjacent its lower ends rest on said respective stops when pivoted to the position for use of said blade as a scoop to gather snow.

17. The tool of claim 16 in which said pivotal connections and stops are located on the opposite facing interior surfaces of said rear portions of said strip within said snow gathering cavity.

18. The tool of claim 13 in which said strip is composed of plastic material having a low coefficient of friction and high impact strength and resistance to abrasion.

19. A snow clearing tool selectively usable either to plow or to gather snow comprising:

a snow clearing blade formed by an elongated generally rectangular strip of flexible plastic material placed in a flexed state and disposed with its height dimension extending generally perpendicular, and its length dimension extending generally parallel, relative to a surface to be cleared of snow, said strip being composed of plastic material having a low coefficient of friction and high impact strength and resistance to abrasion, said strip when placed in said flexed state having a pair of laterally spaced apart rear portions which merge into a forward generally parabolic convex snow plow defining portion and together therewith define a concave snow gathering cavity being open at the top, bottom and rear end thereof;

a handle having an upper gripping portion and laterally spaced apart lower portions extending along interior sides of and being pivotally connected respectively to said spaced apart rear portions of said strip of flexible material so as to restrain said strip forming said blade in its flexed state such that said strip and thus the blade formed thereby naturally assume a generally parabolic curvature, said handle being pivotal relative to said strip between respective positions for permitting use of said blade to plow snow at its forward convex portion or to gather snow within its concave cavity through said open rear end thereof; and stops mounted to said rear portions of said strip adjacent the pivotal connections of said handle to said strip such that said lower portions of said handle rest on said respective stops when pivoted to the position for use of said blade as a scoop to gather snow.

* * * * *